US006755960B1

(12) United States Patent
Frischauf et al.

(10) Patent No.: US 6,755,960 B1
(45) Date of Patent: Jun. 29, 2004

(54) ZINC-NICKEL ELECTROPLATING

(75) Inventors: Robert E. Frischauf, Lakewood, OH (US); William E. Eckles, Cleveland Heights, OH (US)

(73) Assignee: Taskem Inc., Brooklyn Heights, OH (US)

( * ) Notice: Subject to any disclaimer, the term of this patent is extended or adjusted under 35 U.S.C. 154(b) by 50 days.

(21) Appl. No.: 10/296,661

(22) PCT Filed: Jun. 15, 2000

(86) PCT No.: PCT/US00/40208

§ 371 (c)(1),
(2), (4) Date: Nov. 25, 2002

(87) PCT Pub. No.: WO01/96631

PCT Pub. Date: Dec. 20, 2001

(51) Int. Cl.[7] ..... C25D 3/56; C25D 17/10

(52) U.S. Cl. ..... 205/246; 204/252; 204/282; 205/256

(58) Field of Search ..... 204/252, 263, 204/264, 282; 205/246, 256

(56) References Cited

U.S. PATENT DOCUMENTS 4,778,572 A 10/1988 Brown
5,162,079 A 11/1992 Brown
5,417,840 A 5/1995 Block et al.
5,582,709 A 12/1996 Oshima et al.
6,602,394 B1 * 8/2003 Hillebrand ..... 205/246

FOREIGN PATENT DOCUMENTS

DE 19834353 A1 2/2000
JP 59799 1/1993
WO WO0196631 A1 12/2001

* cited by examiner

*Primary Examiner*—Roy King
*Assistant Examiner*—William T. Leader
(74) *Attorney, Agent, or Firm*—Tarolli, Sundheim, Covell & Tummino L.L.P.

(57) ABSTRACT

The present invention relates to an apparatus (12) for applying a zinc-nickel electroplate to a workpiece. The apparatus comprises a zinc-nickel electroplating bath (16) comprising an amine additive, such as poly(alkyleneimine), which is capable of being oxidized in the bath to cyanides. The bath has a pH more than about 14. A cathode workpiece (18) is positioned in the bath. An anode assembly (20) is also positioned in the bath. The anode assembly comprises an enclosure (22) defining an anolyte compartment (24), at least a portion of the enclosure being an ion exchange membrane (26). An anolyte (28) is positioned in the compartment. An insoluble metal anode (30) is immersed in the anolyte. The anolyte is a conductive salt or base solution and the anode is a metal or metal coating selected from the group consisting of nickel, cobalt, iron, chromium and alloys thereof.

11 Claims, 1 Drawing Sheet

ZINC-NICKEL ELECTROPLATING

BACKGROUND OF THE INVENTION

1. Technical Field

The present invention relates to an apparatus and process for zinc-nickel electroplating.

2. Description of the Prior Art

U.S. Pat. No. 5,162,079 discloses an apparatus for electroplating metals. The apparatus comprises an electroplating bath which contains a plating solution of a metallic salt, for instance, nickel sulfate. A cathode workpiece is positioned in the bath. An insoluble anode assembly is also provided in the bath. The anode assembly includes an anode which is essentially insoluble during electroplating and an anion exchange membrane enclosure around the anode. An electrically conductive acid solution is contained within the enclosure of the anode assembly. The flow of current in the apparatus causes anions, for instance sulfate ions, in the plating solution to travel through the anion exchange membrane increasing the acid concentration within the anode assembly enclosure. Accumulated acid is periodically flushed from the enclosure. One purpose of the apparatus of the '079 patent is to inhibit the increase in concentration of dissolved metal in the electroplating bath due to a cathode efficiency which is less than the anode efficiency.

U.S. Pat. No. 4,778,572 discloses an apparatus similar to that of the '079 patent. An electroplating apparatus for plating nickel onto a workpiece is provided. A nickel-plating bath is provided in the apparatus. The bath is a typical Watts nickel low pH acid bath. A cathode workplece is positioned in the bath. An anode structure is also positioned in the bath. The anode structure comprises a series of nickel plate anodes. The nickel plate anodes are enclosed in an ion exchange membrane that allows a current flow from the anodes to the cathode workpiece while at the same time shielding the anodes from organics, such as Coumarin within the bath. The nickel plate anodes are immersed in dilute sulfuric acid contained within the ion exchange membrane enclosure.

German Patent Publication DE 19834353A1 published Feb.3, 2000, discloses an apparatus similar to that of the '079 patent for applying a zinc-nickel coating onto a cathode workpiece. The apparatus comprises a vessel which is divided by a cation exchange membrane into a cathode compartment containing a catholyte and an anode compartment containing an anolyte. The catholyte is an alkaline zinc-nickel electroplating bath containing poly (alkyleneimine) additives for complexing and brightening. A cathode workpiece to be plated is positioned in the cathode compartment. The anolyte is an acid such as sulfuric acid or phosphoric acid. A platinum coated titanium anode is immersed in the anolyte. The ion exchange membrane allows the flow of current from the anode to the cathode, but at the same time shields the anode from the alkaline zinc-nickel electroplating bath.

Electrolysis of alkaline zinc-nickel baths containing poly (alkyleneimines) produces amine breakdown at the anode into nitriles and cyanides if the anode is exposed to the plating bath. The ion exchange membrane prevents such amine breakdown. However, an apparatus which comprises an alkaline electroplating bath adjacent to an acid anolyte can be dangerous. In addition, a platinum coated titanium anode is expensive.

BRIEF DESCRIPTION OF THE DRAWINGS

The present invention and advantages thereof will become more apparent upon consideration of the following specification with reference to the accompanying drawings in which.

SUMMARY OF THE INVENTION

Figure 1:
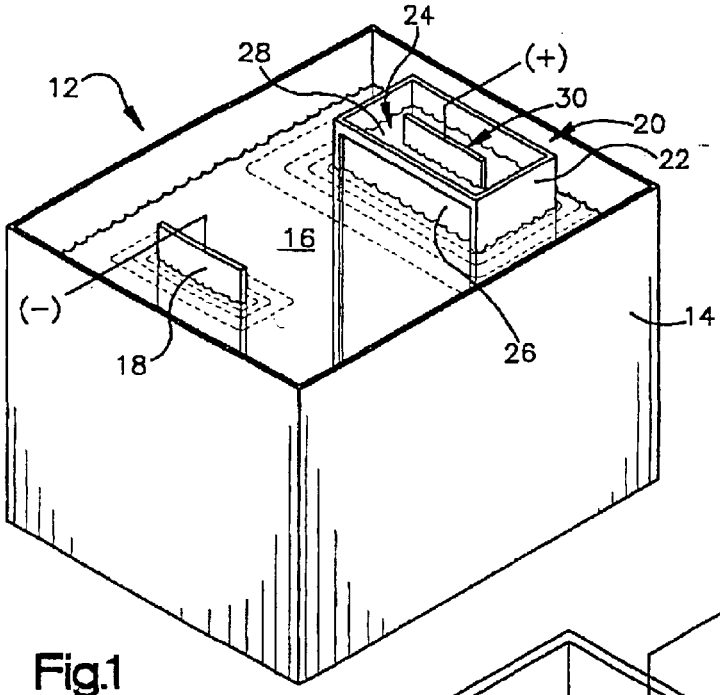
FIG. 1 is a schematic Illustration of a zinc-nickel electroplating apparatus in accordance with the present invention.
Figure 2:
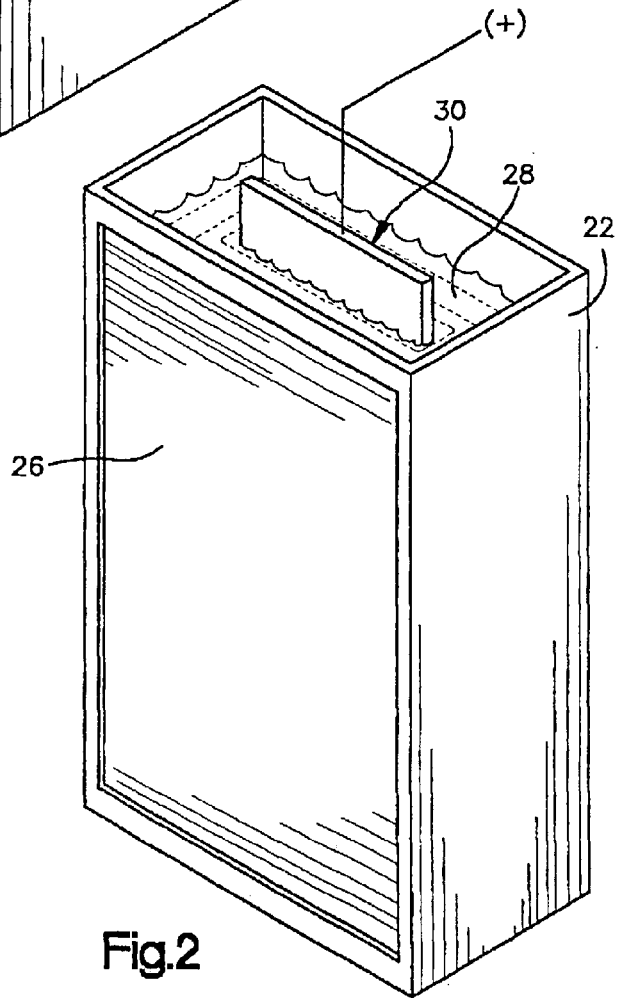
FIG. 2 is a schematic illustration of an anode assembly in the apparatus of FIG. 1

The present invention relates to an apparatus for applying a zinc-nickel electroplate to a workpiece. The apparatus comprises a zinc-nickel electroplating bath comprising an amine additive, such as a poly(alkyleneimines) capable of being oxidized in the bath to cyanides. The bath has a pH more than about 14. A cathode workpiece is positioned in said bath. An anode assembly is in contact with the bath. The anode assembly comprises an enclosure defining an anolyte compartment, at least a portion of the enclosure in contact with the bath being an ion exchange membrane. An anolyte is positioned in the compartment. An insoluble metal anode is immersed in the anolyte. The anolyte is a conductive salt or base solution and the anode is a metal or metal coating selected from the group consisting of nickel, cobalt, iron, chromium and alloys thereof.

A preferred anolyte is a solution of 50 to about 760 g/liter of sodium hydroxide.

A preferred anode is a nickel or a nickel alloy or coating thereof coated onto a substrate.

The present invention also resides in a process for applying a zinc-nickel electroplate to a workpiece. A zinc-nickel electroplating bath comprising amine additives and having a pH more than about 14 is provided. A cathode workpiece is positioned in the bath. An anode assembly is in contact with the bath. The anode assembly comprises an enclosure defining an anolyte compartment, at least a portion of the enclosure in contact with the bath being an ion exchange membrane. An anolyte is positioned in the compartment. An insoluble metal anode is immersed in the anolyte. The anolyte is a conductive salt or base solution and the anode is a metal or metal coating selected from the group consisting of nickel, cobalt, iron, chromium and alloys thereof. A potential is applied between the anode and cathode establishing a current flow from the anode to the cathode through the ion exchange membrane. The ion exchange membrane shields the anode from the zinc-nickel electroplating bath preventing amine breakdown into cyanides.

DESCRIPTION OF PREFERRED EMBODIMENTS

Referring to the FIG., the zinc-nickel electroplating apparatus 12 of the present invention comprises a tank 14. The tank 14 contains a zinc-nickel electroplating bath 16 and a cathode workpiece 18. The tank 14 also comprises an anode assembly 20. The anode assembly 20 comprises an enclosure 22 which defines an anolyte compartment 24. The compartment 24 is closed by the enclosure 22 on all sides and the bottom. At least one wall 26 of the enclosure 22 is an ion exchange membrane. The anolyte compartment 24 comprises an anolyte 28. An anode 30 is immersed in the anolyte 28. The enclosure 22 shields the anode 30 from the electroplating bath 16 so that no bath 16 contacts the anode 30. The ion exchange membrane 26 faces the cathode workpiece 18. This allows current to flow from the anode 30 to the cathode workpiece 18 on the application of an electric potential to the anode 30 and the cathode workpiece 18. The current flow causes plating of the cathode workpiece 18.

It will be understood by those skilled in the art that the enclosure 22 and compartment 24 can have many configurations, for instance, a membrane bag suspended in the catholyte, or a membrane containing wall extending cross-wise in the tank 14 dividing the tank 14 into a catholyte compartment or an anolyte compartment.

In the present invention, the cathode workpiece 18 is any workpiece typically used in zinc-nickel electroplating. In the example of the Figures, a steel plate was used.

The enclosure 22 of the anode assembly 20 can be made of any suitable plastic resistant to the zinc-nickel electroplating bath 16 and the anolyte 28, for instance, polyethylene.

The ion exchange membrane 26 of the enclosure 22 can be any ion exchange membrane used in an electroplating bath, for example, an ion exchange membrane, such as a perfluorosulfonic acid ion exchange membrane, marketed by E. I. DuPont de Nemours under the trademark NAFION. In the following Examples, a NAFION 450 membrane was used.

The anolyte 28 in the anolyte compartment 24 is a conductive salt or base solution, for example, an aqueous solution of sodium sulfate or an alkaline solution of potassium hydroxide or sodium hydroxide. These alkaline solutions can have concentrations, by way of example, in the range of one molar to about 20 molar hydroxide, with a preferred concentration range of 1 to 10 molar. A preferred anolyte is about 50 g/liter sodium hydroxide to about 760 g/liter.

The anode 30 of the anode assembly 20 is a metal or a metal coating selected from the group consisting of nickel, cobalt, iron, chromium, and alloys thereof. For instance, the anode 30 can be nickel, a nickel alloy, nickel coated onto a substrate, or a nickel alloy coated onto a substrate. The substrate can be metal, such as steel, copper, or aluminum or a plastic. An example of a nickel alloy is Hastelloy, which is 55% nickel and 45% chromium. The nickel or nickel alloy can be electroplated onto a substrate using a Watts type plating bath, or using an electroless nickel or nickel alloy plating process. Similarly, the anode 30 can be cobalt or cobalt coated onto a substrate, and alloys thereof. The anode can also be a mild steel, a steel alloy, or an iron chromium alloy such as stainless steel.

The zinc-nickel electroplating bath is an aqueous solution that is alkaline having a pH which is preferably above about 14. The bath contains an inorganic alkaline component in an effective amount to achieve this pH. Amounts from about 50 grams per liter to about 200 grams per liter, based on the electroplating bath of the alkaline component can be used. Examples of suitable alkaline components are alkali metal derivatives such as sodium hydroxide, potassium hydroxide, sodium carbonate and potassium carbonate.

The electroplating bath 16 also contains a controlled amount of zinc ions and a controlled amount of nickel ions. The source for the zinc ions for the electroplating bath 16 can be any zinc compound which is soluble in an alkaline aqueous medium. Examples of zinc compounds which can be added to the electroplating bath are zinc oxide or a soluble salt such as zinc sulfate, zinc carbonate, zinc sulfamate, and zinc acetate. The concentration of zinc ions in the electroplating bath is from about 1 to 100 grams per liter, preferably about 4 to about 50 grams per liter (about 4,000 to about 50,000 ppm). At a pH above about 14, the predominant zinc species in the bath is zincate ion.

The source for the nickel ions for the electroplating bath can be any nickel compound which can be made soluble in an aqueous alkaline solution. Examples of suitable nickel compounds are an inorganic or organic acid salt of nickel, such as nickel sulfate, nickel carbonate, nickel acetate, nickel sulfamate and nickel formate. The concentration of nickel ions in the electroplating bath can be from about 0.1 to about 10 grams per liter (about 100 to 10,000 ppm), more preferably in the range from about 0.1 gram per liter to about 3 grams per liter (about 100 ppm to about 3,000 ppm).

The zinc-nickel electroplating bath also contains an amine compound capable of being oxidized to cyanides in the bath, such as a polymer of an aliphatic amine. Examples of aliphatic amine polymers oxidizable to cyanides in the bath are ethyleneimine, 1,2-propylenelmine, 1,2-butyleneimine and 1,1-dimethylethyleneimine. The poly(alkyleneimines) may have molecular weights from about 100 to about 100,000 and should be soluble in the bath. By way of example, poly(ethyleneimine) which is useful in the bath can have a molecular weight of from about 150 to above about 2,000. Useful poly(ethyleneimines) are available commercially, for example from BASF under the designations LUGALVAN G-15, LUGALVAN G-20 and LUGALVAN G-35. Examples of other useful poly(alkyleneimines) are tetraethylenepentamine (TEPA), pentaethylenehexamine (PEHA), and heptaethylene octamine marketed by Nippon Shokubai Co. Ltd. under the trademark EPOMIN 003.

One function of the aliphatic poly(alkyleneimines) is to complex nickel ions in the alkaline zinc-nickel bath.

It will be understood by those skilled in the art that the zinc-nickel electroplating bath may also contain other additives such as other brighteners, and metal complexing agents. One useful metal complexing agent is QUADROL from BASF. QUADROL is N,N,N',N'-tetrakis(2-hydroxypropyl)-ethylenediamine.

With regard to the metal anode 30, copper and tin were tested as metal anodes in the anode box, but both dissolved during electrolysis. Zinc was tested but polarized severely. A graphite electrode was also tested. The graphite decomposed, and the anode box became filled with graphite particles. Iridium oxide on titanium was tested, but there was significant deterioration of the coating during electrolysis.

The following Examples Illustrate the present invention.

EXAMPLE 1

The alkaline zinc-nickel bath was one gallon containing 10 g/liter of zinc, 1.5 g/liter of nickel, 20 g/liter of tetraethylenepentamine (TEPA) and 10 g/liter of QUADROL. An anode box (disclosed in the Figure) having a NAFION 450 membrane on one side, containing 500 ml of a solution of 150 g of sodium hydroxide was placed in the zinc-nickel bath. A metal anode was placed in the anode box. The metal anode was made of a coating of electroless nickel (containing 10% P) on steel. 5.0 Amperes of current were passed through the one-gallon cell for 6 hours. The plating bath was analyzed for cyanide, and no cyanide was detected. There was no erosion of the electroless coated steel anode in the anode box.

EXAMPLE 2

In this Example, the anode box was filled with a solution of 150 g/liter of sodium hydroxide in water. The metal anode in the box was made of nickel metal. A one-gallon cell, similar to Example 1, was run at 5 amperes for 6 hours as before. The plating bath was analyzed for cyanide, and no cyanide was detected. The nickel anode had a thin conductive coating of nickel oxide/nickel hydroxide which did not interfere with the plating process. There was no weight loss of nickel anode.

EXAMPLE 3

The anode box of Example 1 was filled with a 20% solution of 50% liquid caustic. The metal anode was nickel electroplated from a Watts type plating solution, onto a steel base metal. The bath was run at 5 amperes and 6.84 volts for 6 hours. The plating bath was analyzed for cyanide, and no cyanide was detected. There was no metal anode weight loss.

EXAMPLE 4

A 1-gallon zinc-nickel plating bath, similar to the bath in Example 1, was electrolyzed for 100 ampere hours, using a box anode with a NAFION 450 ion exchange membrane covering one side of the box. The anode in the box was steel coated with electroless nickel with contained 8% P. After 100 ampere hours, the bath was analyzed for cyanide and was found to contain no detectable cyanide. There was no metal anode weight loss.

COMPARATIVE EXAMPLE 5

A 2-liter alkaline zinc-nickel plating bath containing 30 g/liter of a polyethyleneimine (TEPA) was electrolyzed for 160 ampere hours with a nickel anode placed directly into the plating bath. The bath was found to contain 508 ppm of cyanide.

EXAMPLE 6

The anode box of Example 1 was filed with a solution of 150 g/liter of potassium hydroxide. The metal anode in the anolyte was a mild steel Q-panel. The bath, which was similar to the bath of Example 1, was electrolyzed at 5 amperes for 6 hours. There was a slight loss of weight from the steel anode. The electrolyte was analyzed for cyanide, and no cyanide was detected.

EXAMPLE 7

The anode box of Example 1 is filled with a solution of 150 g/liter of sodium hydroxide. The metal anode in the box is cobalt. The alkaline zinc-nickel bath contains 20 g/liter of poly(ethyleneimine) and is electrolyzed for 30 amp-hours.

EXAMPLE 8

The metal anode in the anode box of Example 1 is steel coated with cobalt. The plating bath is similar to Example 1. The anolyte in the box is a 20% solution of 50% liquid caustic.

EXAMPLE 9

The metal anode in the anode box in this Example, is a cobalt alloy anode. The anolyte is a 20% solution of 50% liquid caustic. The plating bath and apparatus are similar to Example 1.

EXAMPLE 10

The metal anode in this Example is steel coated with a cobalt alloy coating from an electroless, cobalt-plating bath. The zinc-nickel plating bath and apparatus are similar to Example 1. The anode box contains a 15% solution of 50% liquid caustic. The alkaline zinc-nickel bath is electrolyzed for 6 hours at 5.0 amperes.

EXAMPLE 11

In this Example, the metal anode in the anode box was stainless steel. The plating bath and apparatus were similar to Example 1. After 30-ampere hours, there was no detectable cyanide. There was no weight loss from the stainless steel anode.

By the present invention, an apparatus and process are provided by which zinc-nickel can be safely plated onto a substrate using an alkaline zinc-nickel electroplating bath containing polyamines, especially poly(alkylenelmines). This is accomplished without anode erosion or generating cyanides in the electroplating bath.

It will be understood by those skilled in the art that a commercial apparatus and process will employ a zinc-nickel electroplating bath comprising additives in addition to a poly(alkyleneimine) such as other brighteners and sequestrants. In addition, a commercial bath typically can employ a 1000 gallon tank and the cathode workpiece positioned between arrays of compartmentalized anodes on opposite sides of the cathode along the sides of the tank.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for applying a zinc-nickel electroplate to a workpiece comprising:

(a) a zinc-nickel electroplating bath comprising an amine additive and having a pH more than about 14;

(b) a cathode workpiece in said bath;

(c) an anode assembly in said bath comprising:

(i) an enclosure defining an anolyte compartment, at least a portion of the enclosure being an ion exchange membrane;

(ii) an anolyte in said compartment; and (iii) an insoluble metal anode immersed in said anolyte;

wherein the anolyte is a conductive salt or base solution and the anode is a metal or metal coating selected from the group consisting of nickel, cobalt, iron, chromium and alloys thereof.

2. The apparatus of claim 1 wherein said amine additive is a poly(alkylenelmine).

3. The apparatus of claim 2 wherein said zinc-nickel bath comprises poly(ethyleneimines).

4. The apparatus of claim 3 wherein said anode is nickel, a nickel alloy, a nickel coating, or a nickel alloy coating and said anolyte is a sodium or potassium hydroxide solution comprising 50 to about 760 grams per liter sodium or potassium hydroxide.

5. The apparatus of claim 4 wherein said anode is electroless nickel or alloy thereof coated on a substrate, or Watts-nickel or alloy thereof coated on a substrate.

6. A process for applying a zinc-nickel electroplate to a workpiece comprising the steps of:

(a) providing the apparatus of claim 1; and (b) applying a potential to the anode and cathode workpiece of said apparatus to cause a current flow from the anode to the cathode and plating of said workpiece.

7. A process for applying a zinc-nickel electroplate to a workpiece comprising the steps of:

(a) providing a zinc-nickel electroplating bath comprising an amine additive and having a pH more than about 14;

(b) positioning a cathode workpiece in said bath;

(c) providing an anode assembly in said bath comprising:

(i) an enclosure defining an anolyte compartment, at least a portion of said enclosure being an ion exchange membrane;

(ii) an anolyte in said compartment; and (iii) an insoluble metal anode immersed in said anolyte, wherein the anolyte is a conductive salt or base solution and the anode is a metal or metal coating selected from the group consisting of nickel, cobalt, iron, chromium and alloys thereof, (d) applying a potential to said anode and cathode to cause a current flow from the anode to the cathode through said ion exchange membrane.

8. The process of claim 7 wherein said amine additive is poly(alkylenelmine).

9. The process of claim 8 wherein said zinc-nickel bath comprises poly(ethyleneimine).

10. A process according to claim 9 wherein said anode is nickel, a nickel alloy, a nickel coating, or a nickel alloy coating and said anolyte is a sodium or potassium hydroxide solution comprising 50 to about 760 grams per liter sodium or potassium hydroxide.

11. A process according to claim 10 wherein said anode is electroless nickel or alloy thereof coated on a substrate, or Watts-nickel or alloy thereof coated on a substrate.

* * * * *

UNITED STATES PATENT AND TRADEMARK OFFICE

CERTIFICATE OF CORRECTION

PATENT NO. : 6,755,960 B1 
DATED : June 29, 2004
INVENTOR(S) : Robert E. Frischauf and William E. Eckles It is certified that error appears in the above-identified patent and that said Letters Patent is hereby corrected as shown below:

Column 4,
Line 11, after "ethyleneimine" change "1,2-propylenelmine" to -- 1-2,propyleneimine --.

Column 6,
Line 7, after "especially" change "poly(alkylenelmines)" to -- poly(alkyleneimines) --.
Line 41, after "a" change "poly(alkylenelmine)" to -- poly(alkyleneimine) --.

Column 7,
Line 11, after "is" change "poly(alkylenelmine)" to -- poly(alkyleneimine) --.

Signed and Sealed this

Thirtieth Day of November, 2004

JON W. DUDAS
*Director of the United States Patent and Trademark Office*